United States Patent [19]

Dion

[11] Patent Number: 4,577,857

[45] **Date of Patent: * Mar. 25, 1986**

[54] SIMPLIFIED APPARATUS FOR USE IN ARM WRESTLING OR WRIST PULLING CONTESTS

[76] Inventor: Exsior Dion, 547 River Rd., Lincoln, R.I. 02865

[ * ] Notice: The portion of the term of this patent subsequent to Jan. 24, 2001 has been disclaimed.

[21] Appl. No.: 502,224

[22] Filed: Jun. 8, 1983

[51] Int. Cl.[4] ..... A63B 5/00; A63B 67/00

[52] U.S. Cl. ..... 272/67; 272/901; 273/1 GC

[58] Field of Search ..... 272/134, 901, 67, 68, 272/93, DIG. 5, 130, 132, 136; 273/1 R, 1 GI, 1 GC

[56] References Cited

U.S. PATENT DOCUMENTS

| | | | |
|---|---|---|---|
| 3,662,602 | 5/1972 | Weiss | 272/DIG. 5 |
| 3,713,653 | 1/1973 | Romans | 272/67 |
| 3,743,284 | 7/1973 | Rhodes et al. | 272/93 |
| 4,131,275 | 12/1978 | Gandy et al. | 272/901 |
| 4,176,837 | 12/1979 | Jeffrey et al. | 272/DIG. 5 |
| 4,214,748 | 7/1980 | Blackmon | 272/67 |
| 4,427,194 | 1/1984 | Dion | 272/901 |

*Primary Examiner*—Richard J. Apley
*Assistant Examiner*—S. R. Crow
*Attorney, Agent, or Firm*—Robert J. Doherty

[57] ABSTRACT

Apparatus for conducting arm wrestling (wrist pulling) contests between a pair of opposed contestants comprising a playing surface in which a lever arm is adapted for pivotal side-to-side motion. The opposed contestants each grip a laterally spaced portion of the lever arm in an attempt to force such to one side of its travel limit and against the opponent's urging. The ends of the lever arm are adapted to contact signal means extending above the playing surface at the opposite ends of the travel limit of such lever arm which are in turn activated upon contacting the lever arm so as to signal a contest winner.

3 Claims, 3 Drawing Figures

SIMPLIFIED APPARATUS FOR USE IN ARM WRESTLING OR WRIST PULLING CONTESTS

BACKGROUND AND OBJECTS OF THE INVENTION

The present application is related to my previously filed patent application identified as Ser. No. 454,043 filed Dec. 28, 1982 and entitled APPARATUS FOR USE IN ARM WRESTLING OR WRIST PULLING CONTESTS. Both the present invention and the above referred to invention deal with novel apparata for conducting strength contests generally referred to as arm wrestling or wrist pulling and more particularly to such apparata wherein various techniques generally considered to be unfair are entirely or at least to a great extent eliminated. In such arm wrestling contest, the overall object is to grasp hands with an opponent and thereafter attempt to force his arm downwardly onto a contest surface such as a table or the like. In such contest the opponent's elbows should remain generally in place and the force applied such that the back and forth arm motion takes place in an upright plane generally normal to the contest surface. There are, however, several techniques for gaining an unfair advantage over an opponent including 1) instead of pushing the opponent's arm towards the down position, the opponent's hand is pulled away from him leaving his wrist and hand bent slightly backway thereby reducing his pushing power (this is known as "breaking the opponent's wrist"); 2) instead of pushing the opponent's arm towards the down position, his arm is pulled away from him leaving his arm outstretched accordingly reducing his pushing power; 3) instead of pushing the opponent's arm towards the down position, the opponent's arm is held in either of the positions described in 1 and 2 above (this action tires the opponent); 4) to reduce the opponent's power, body weight is utilized in conjunction with the techniques described in 1, 2, and 3 above; 5) the use of the non-pulling arm as a brace against any object either alone or when combined with techniques described in 1 to 4 above also helps to unfairly overcome an opponent; and 6) feet bracing by contacting one's feet in a bracing position to the floor or leg bracing to portions of the table or bench on which players are positioned is another technique either utilized alone or in conjunction with the techniques described in 1 through 4 above also adds strength to unfairly overcome an opponent. Eliminating or reducing these unfair techniques is accomplished by my previously referred to invention by use of somewhat sophisticated or complex apparatus and there remains a need for accomplishing those objectives with less complex and, accordingly, less costly apparatus.

It is, accordingly, the overall object of the present invention to present an apparatus of a particular simple and straightforward construction which when utilized in such arm wrestling contest will eliminate or at least reduce the number of unfair advantages or tricks that one opponent can utilize against another so as to generally assist in the promotion of fairness in such contest. The above and other objects of the present invention are accomplished by the provision of an apparatus for conducting arm wrestling contest between a pair of opposed contestants comprising a generally planar contest surface having separate stop means longitudinally spaced from each other generally along the median line of said surface, an elongated lever arm having upper and lower ends, said lever arm pivotally supported at its lower end proximate said contest surface and adapted to contact said stop means at opposite ends of its side-to-side arcuate travel movement within the limits defined by said stop means, said arm including a pair of laterally spaced hand grip portions positioned along the extent of said arm intermediate the ends thereof, signal means including separate longitudinally spaced activation means positioned on said surface between said pivot support and said stop means for contact by said arm just prior to movement to either of its side-to-side limits for activating said signal means.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
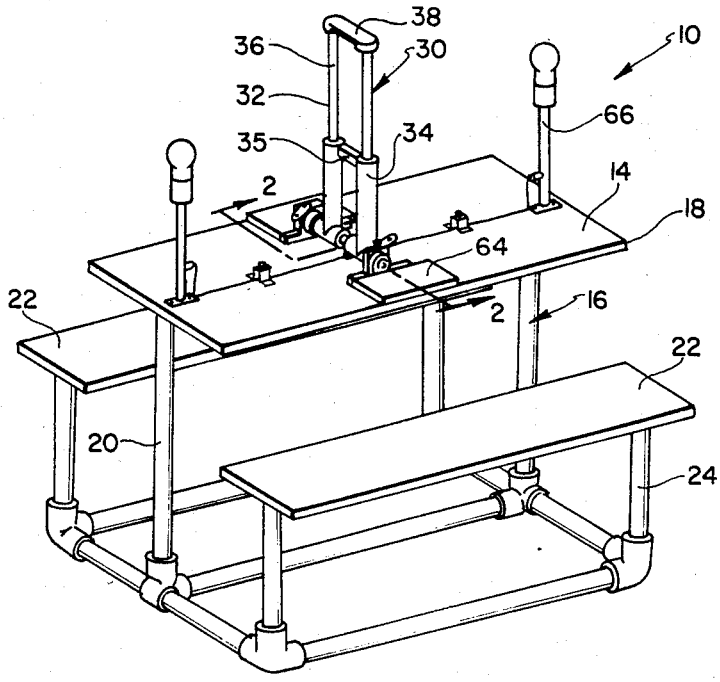
FIG. 1 is a perspective view showing the manner in which the apparatus of the present invention may be mounted on a contest surface so as to enhance the fairness of arm wrestling contest.

Turning now to the drawing and more particularly to FIG. 1 thereof, the overall configuration of the device of the present invention is best shown. Such device or apparatus 10 is preferably utilized in conjunction with a contest surface 14 defined by the upper surface of a conventional table or may be utilized as shown in FIG. 1 with the combined bench and table 16 shown therein. As illustrated in FIG. 1, a contest surface 14 is formed by the upper surface of a relatively long table top 18 supported at a higher than normal height by a supporting structure, i.e., the laterally opposed legs 20 shown. A pair of benches 22 also supported at a higher than normal height away from the floor, ground, etc. are positioned on opposite sides of the table 18 such that the contestants may sit on the benches in opposed facing positions to each other. In this manner the opponent's legs will not be able to touch the ground or the supporting legs 24 of the benches 22 by reason of their spacing will not be able to be contacted by the opponent's legs as well. The use of this novel table in conjunction with the apparatus 10 of the present invention eliminates the unfair advantages previously described as leg and foot bracing. It should be brought out, however, that the device 10 of the present invention has utility separate and apart from its above-described use in conjunction with the novel table and bench structure above defined.

Figure 2:
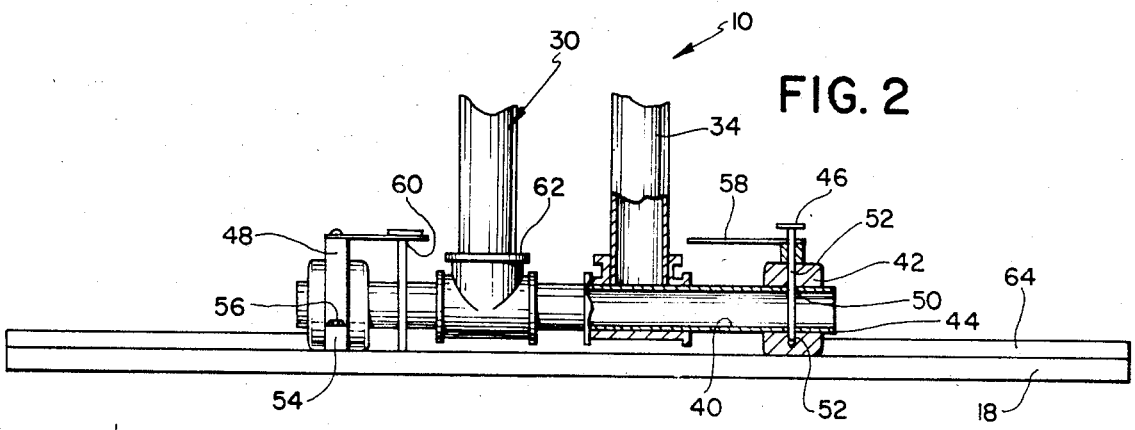
FIG. 2 is an elevated partial sectional view of the apparatus on an enlarged scale and taken along the line 2—2 of FIG. 1.
Figure 3:
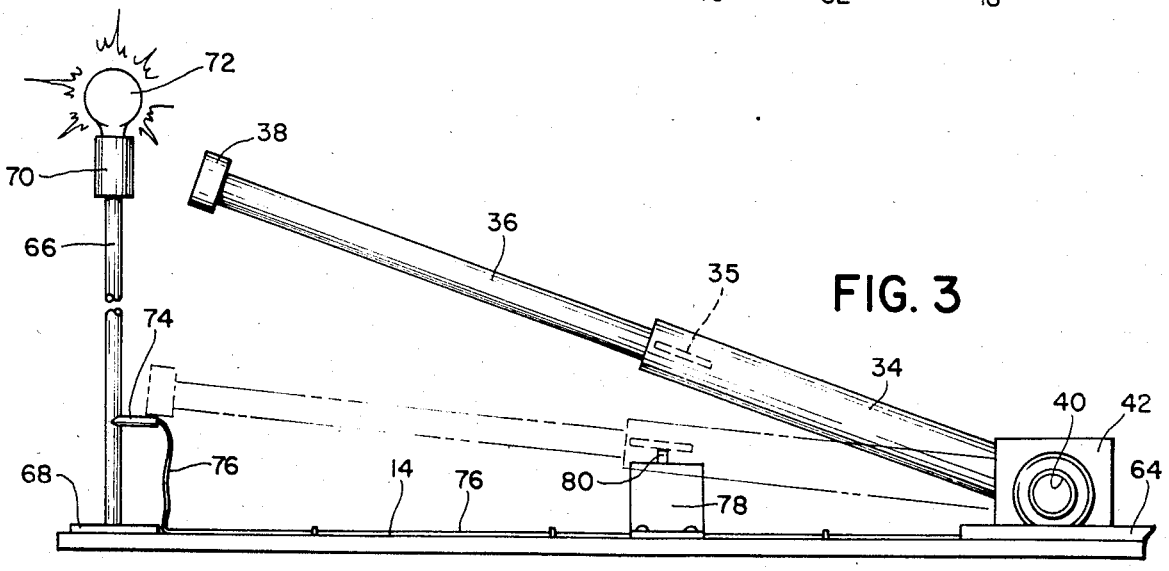
FIG. 3 is a partial front view showing the operational manner of the device.

Turning now to FIGS. 1–3 of the drawing, the structure of the device 10 is best shown. Therein a lever arm 30 is positioned on top of the contest surface 14 for back and forth pivotal movement with respect thereto. Such lever arm 30 includes a pair of laterally separated post members 32 which are adapted to be engaged by the opposing contest members on opposite sides of the table top 18. Such upright members 32 may include a lower tubular portion 34 and an upper preferably slightly narrower diameter tubular portion 36 to which adhesive material such as tape and the like may be adhered by wrapping or other conventional techniques so as to form the hand grip portions of the lever arm 30. These upper members 36 may be connected at their top by a top connecting member 38 and at an intermediate location by a cross member 35. The lower member portions 34 are connected at their bottom ends to a tubular lower member 40 which extends transversely, that is, laterally, across the table top 18 and is supported at its opposite ends thereof in a pair of laterally separated trunnions 42.

As best shown in FIG. 2, the lower member 40 is hollow and is positioned at its opposite ends 44 in the trunnion 42 for rotational movement as may be experienced during the contest by the contestants who attempt to force the lever arm 30 to its opposite pivotal extent against the urging of the opponent in order to decide the contest in the normal manner. In order to maintain the lever arm 30 in an upright position prior to the beginning of a contest such that the contestants may ready themselves and as will be hereinafter more fully brought out so that the lever arm 30 will not contact and activate signal means associated with the device 10, means in the form of a pair of pins 46 are included in the structure of the device. Such pins 46 are adapted to extend through the normal clamp portion 48 and into the lower tubular member 40. A pair of aligned openings are provided through the tubular member 40 for this purpose. Such openings 50 are in addition aligned with a bore 52 extending through the body of each trunnion 42. Such trunnions are of normal split halve configuration and may be bolted or otherwise attached to the playing surface 14 by means of ears 54 extending therefrom through which bolts 56 may fasten the device 10 to the table top 18. Alternatively, the device 10 may be affixed to a separate platform which may in turn be affixed to the table top 18 by any conventional means such that the device has enhanced portability.

A plate 58 extends from the top of the trunnion 42 to a laterally offset position with regard thereto and is provided with an opening 60 therethrough such that the pin 46 may be placed therethrough in a rest or storage position when not utilized to hold the lever arm 30 in an upright position as previously described. Preferably in using the pin 46 to hold the lever arm 30 in an upright position, both pins 46 are utilized, and they extend through the lower member 40 and into that portion of the trunnion hole 52 located in the lower trunnion half although adequate upright positioning of the lever arm 30 may be secured by using only one pin and by placing either one or both pins such that they extend at least partially through the lower member 40, that is, that they do not extend entirely through. The above pin positioning is, of course, dependent on the weight, the diameter and strength of the pins, as well as the security desired. Also it should be brought out that while the lever arm 30 is shown as connected to the lower tubular member 40 by means of standard threaded T connections 62, it should be clear that such connection may be accomplished by welding or other conventional means.

In further describing the device 10, it should be pointed out that elbow pads 64 may be positioned adjacent the trunnions 42 such that the contestants may place their elbows thereon in position for the contest and that such pads 64 may be of varying thicknesses to accomplish height elevation if needed. A pair of posts 66 are provided on the playing surface 14 and upwardly extend therefrom. Such posts 66 are preferably of hollow metallic construction and are screw fastened to a base plate 68 which in turn is fastened to the playing surface by any conventional means. The upper portion of each post 66 is provided with an electrical receptacle 70 for receipt of an electric light 72 or other signal means such as a buzzer, or an alarm or the like. The longitudinal spacing of the posts 66 is such that it is slightly larger than the side-to-side longitudinal extent of the lever arm 30. In this regard, stop means in the form of a horizontally extending nipple or arm 74 may be provided such that the side-to-side lateral movement of the lever arm 30 is limited prior to the time that it would contact the playing surface 14. This is so as to enable some room between the playing surface and the full pivotal extent of the lever arm for a contestant's wrist and hand such that a defeated contestant is not likely to be injured by the impact of the lever arm. This stop means 74 may be of any desired configuration but the hollow nipple depicted is particularly useful in that it provides an entry into the hollow posts 66 for receipt of wiring 76 whereby the signal means 72 may be activated. Such wiring 76 extends along the playing surface 14 to an activation means in the form of a switch 78. A switch 78 is, accordingly, positioned along the median line of the playing surface 14 which longitudinally extends between the posts 66 and the connection point of the lever arm 30 to the table 18 intermediate the trunnions 42 and the posts 66, that is, two such switches 78 are provided on opposite sides of the central connection of the lever arm to the playing surface. Each switch includes an activation button 80 upwardly extending from the top surface thereof which is adapted for contact with the cross member 35 serving to connect the upright members 32 of the lever arm 30 together. The height of such buttons 80 is such that they will be contacted by the cross member 35 just prior to the connecting member 38 contacting the stop means 74. This is such that activation of the signal means 72 is assured. As an alternate embodiment, the switches could be incorporated with the stop means such that actual contact with the stop means by the top or bridging member 38 would provide the necessary contact to insure activation of the signal means.

It is thus apparent that the objects of the present invention have been accomplished by the provision of the apparatus described above and in a convenient, straightforward, and low cost manner which additionally enhances the enjoyment of arm wrestling matches by the elimination of unfair techniques.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Apparatus for conducting arm wrestling contest between a pair of opposed contestants comprising a generally planar contest surface having a pair of longitudinally separated posts positioned along the median line of said surface and having stop means mounted thereon, an elongated lever arm having upper and lower ends, said lever arm pivotally supported at its lower end proximate said contest surface and adapted to contact said stop means at opposite ends of its side-to-side arcuate travel movement within the limits defined by said stop means, said lever arm including a laterally extending generally tubular base portion positioned at opposite ends thereof in trunnions in turn supported by said surface, means for maintaining said lever arm in a generally upright position between the side-to-side limits of its travel movement, said means for maintaining said lever arm upright including a pin adapted to pass through a portion of said trunnion and thence at least partially through said tubular base, there being a pair of such pins, each positioned adjacent one of a pair of said trunnions, said lever arm further including a pair of laterally spaced hand grip portions positioned along the extent of said arm intermediate the ends thereof, signal means supported by said posts above said surface and separate longitudinally spaced activation means positioned on said surface between said pivot support and said stop means for contact by said arm just prior to movement to either of its side-to-side limits for activating said signal means, said activation means including a pair of switches positioned along said median line for contact by said lever arm and said signal means activated upon contact between said lever arm and either of said switches.

2. The apparatus of claim 1, said lever having laterally separated upper portions extending from said base portion to a connecting top portion.

3. The apparatus of claim 1 said signal means being a light mounted at the top of each of said posts.

* * * * *